US006178695B1

(12) United States Patent
Kornegay et al.

(10) Patent No.: US 6,178,695 B1
(45) Date of Patent: Jan. 30, 2001

(54) CONVERTIBLE WINDOW ASSEMBLY

(75) Inventors: David Leslie Kornegay, Hillsborough, NC (US); Charles Lee Allen, Woodstock, GA (US); James Edward Jordan, Marietta, GA (US); Alex Stephen Long; Karl Joseph Meyer, Jr., both of Woodstock, GA (US); Barry Ray Williams, Dallas, GA (US)

(73) Assignee: Carolina Builders, Inc., Raleigh, NC (US)

( * ) Notice: Under 35 U.S.C. 154(b), the term of this patent shall be extended for 0 days.

(21) Appl. No.: 09/280,054

(22) Filed: Mar. 29, 1999

(51) Int. Cl.[7] ..... E05D 15/22; E05D 15/16
(52) U.S. Cl. ..... 49/181; 49/176; 49/428
(58) Field of Search ..... 49/428, 453, 181, 49/429, 430, 446, 161, 445, 447, 448, 454, 455, 176

(56) References Cited

U.S. PATENT DOCUMENTS 3,524,282 * 8/1970 Kraft et al. ..... 49/181
3,789,549 * 2/1974 Yip ..... 49/181
4,363,190 * 12/1982 Anderson ..... 49/181
4,590,708 * 5/1986 Campodonico ..... 49/181
4,718,194 * 1/1988 Fitz Gibbon et al. ..... 49/181
4,854,077 * 8/1989 Rogers et al. ..... 49/181 X
5,127,192 * 7/1992 Cross ..... 49/181
5,301,467 * 4/1994 Schmidt et al. ..... 49/181
5,414,960 * 5/1995 O'Donnell et al. ..... 49/181 X
5,566,507 * 10/1996 Schmidt et al. ..... 49/428
5,649,388 * 7/1997 Best et al. ..... 49/181
5,671,566 * 9/1997 Tix et al. ..... 49/428 X
5,704,165 * 1/1998 Slocomb et al. ..... 49/181
5,855,092 * 1/1999 Raap et al. ..... 49/181

* cited by examiner

*Primary Examiner*—Daniel P. Stodola
*Assistant Examiner*—Hugh B. Thompson
(74) *Attorney, Agent, or Firm*—Hunton & Williams

(57) ABSTRACT

A convertible window system having two window sashes, a weatherstripping, and a tilt pivot assembly. The window system can be readily switched between single-hung and double-hung configuration. The weatherstripping assembly, which is operatively connected to each of the two sashes, has a number of regions. Each of these regions has different attributes which determine the types of translations and rotations that can be performed on a sash with a predetermined force. In a preferred embodiment, an upper sash can be removed from a window frame by the application of a predetermined force on the top of the sash while the sash is within a predetermined range of the weatherstripping assembly without the need for withdrawing guide pins from the channel of the weatherstripping assembly.

20 Claims, 6 Drawing Sheets

CONVERTIBLE WINDOW ASSEMBLY

FIELD OF THE INVENTION

The present invention relates to the field of windows generally and particularly to a window that in shipment is configured as a single-hung window but may optionally be converted to a double-hung window in use.

BACKGROUND OF THE INVENTION

Various types of double-hung windows are well known. Such windows are commonly used in houses and buildings for providing increased ventilation capacity. Such windows typically include a window frame, a weatherstripping assembly, an upper sash and a lower sash. The window frame is the stationary part of the window. It typically consists of a head jamb, a window sill, side jambs, extension jambs and a blind stop. The upper and lower sashes are slidably connected within the window frame.

Typically, the weatherstripping assembly is attached to the window frame, and serves to form a weather-tight seal between the window frame and each of the sashes. The weatherstripping assembly additionally houses the components of the balance assembly, if a balance assembly is utilized in the window system. Springs are often used in balance assemblies to apply an upward force on a sash and reduce the amount of effort required to lift the sash. Double-hung windows generally have two window sashes, each of which can be removed or translated independently. Furthermore, there is no window system which allows a user to readily convert between a single-hung and a double-hung window configuration.

Tilting double-hung windows are designed to be tilted for the purpose of accessing both sides of a window sash from one side of a window frame. Typically, such window systems will have guide pins at the top of each sash. These guide pins interconnect with the weatherstripping assembly to keep the sash aligned with the window frame. In order to remove a window sash, the guide pins are retracted from the weatherstripping assembly and the upper part of the sash can then be rotated about the pivot axis.

Current techniques of repairing, maintaining and cleaning sashes for double-hung windows are inadequate because they do not allow for ready removal of either or both the window sashes.

Current techniques for shipping or transporting window systems have been developed to ship double-hung window systems. For example, some window systems utilize straps and pads to prevent translation and rotation of the individual sashes during movement. Utilizing straps costs additional time and money.

Current techniques for securing window sashes in a double-hung window are similarly inadequate. For example, when a window is open a limited amount, the locking mechanism can no longer provide a secure environment within the house. These and other drawbacks exist.

SUMMARY OF THE INVENTION

An object of this invention is to overcome these and other drawbacks of known systems and techniques.

Another object of the present invention is to provide readily removable window sashes.

Another object of the present invention is to provide a window system that is readily convertible between a double-hung and a single-hung window system.

Another object of the present invention is to provide the security of a locked window while one or more window sashes are open.

Another object of the present invention is to provide the security of a locked window while one or more window sashes are open and, at the same time, comply with building code egress requirements.

According to one preferred embodiment, a window system is provided with two removable window sashes. These window sashes enable ready removal for replacement, maintenance or cleaning.

According to another preferred embodiment, a window system is provided that enables conversion between single-hung and double-hung operation. The conversion can be for purposes of shipping, for reasons desired by a building owner, or for other reasons.

According to another preferred embodiment, a window system is provided having an upper sash that cannot be removed until a lower sash is removed. The window system may have a weatherstripping assembly having two horizontally displaced channels. At least one of these channels may be vertically divided into four regions. In the first region, the upper sash may be held into place by a guide rail extending into a grove of the upper sash. In the second region, a normal force is preferably applied to the side of the sash to prevent unintentional rotation of the sash. In the third region, there preferably are no obstacles, thereby enabling free movement of engaging elements within the third region. In a final region, an extrusion prevents translation of engaging elements to limit the range of translation of the sash.

One of the highly advantageous features of the invention is due to the fact that in shipment, the convertible window assembly of the preferred embodiments has an upper sash which is securely retained in position via screws, which are inserted through holes formed in a tilt pivot assembly. This configuration eliminates the need to ship the window with additional strapping or other devices which are traditionally required to hold the window square in shipment. The provision of holding the window square in shipment not only protects the integrity of the entire window system, including the panes, it also simplifies installation. That is, the convertible window assembly of the preferred embodiment when it arrives at its ultimate destination is in a condition where it is substantially square. Consequently, the builder need only insert the window into the frame and attach the frame to the building structure with little, if any, shimming required. The convertible window assembly according to the preferred embodiments thus greatly reduces the installation time required of the builder by substantially reducing or eliminating altogether any requirement for shimming the window during installation.

Other objects, features and advantages of the preferred embodiments will be apparent when the detailed description of the preferred embodiments is read in conjunction with the drawing figures.

DETAILED DESCRIPTION OF THE PREFERRED EMBODIMENTS

Figure 1:
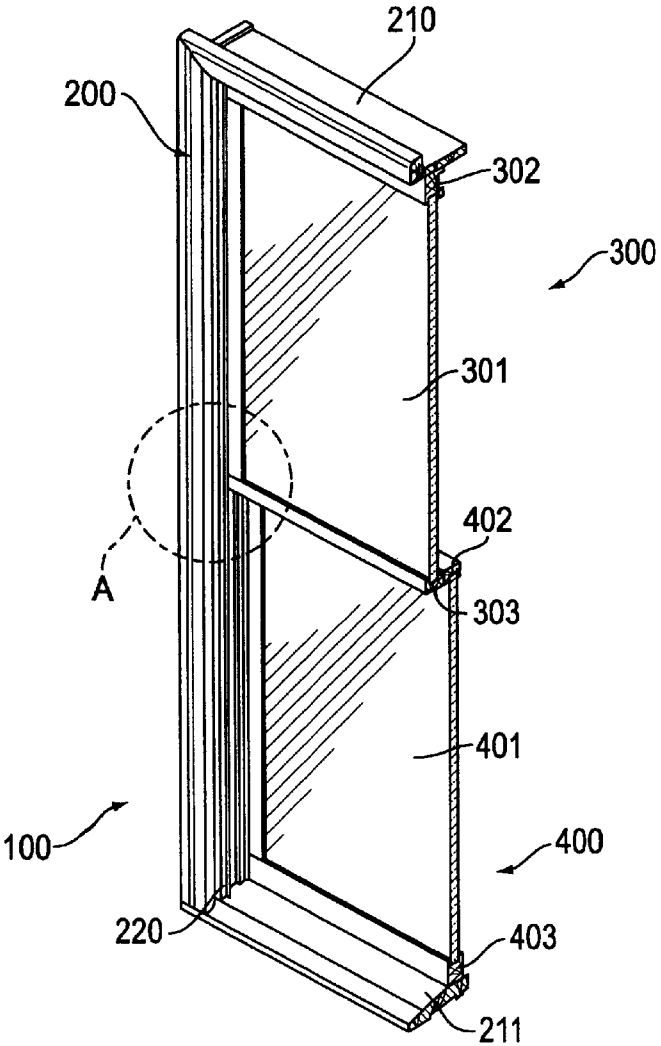
FIG. 1 shows a perspective view of the window system in accordance with the present invention.

FIG. 1 illustrates one embodiment of the window system 100. Preferably, the window system 100 comprises at least a window frame 200, an upper sash 300, a lower sash 400, and a tilt pivot assembly 500 (shown in FIG. 2). The upper sash 300 and the lower sash 400 are generally contained within the window frame 200. Window frame 200 may be attached to a wall of a building or other structure by means that are well known in the art.

Figure 2:
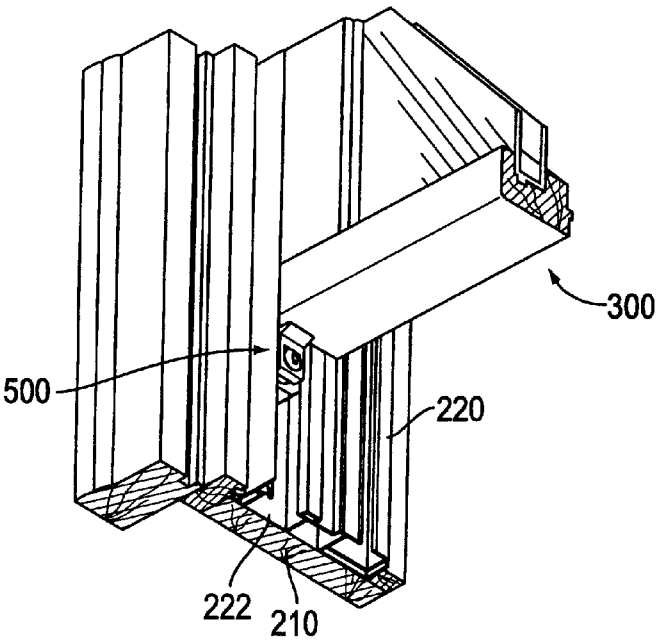
FIG. 2 shows an enlarged, perspective view of section A of FIG. 1, focusing on the tilt pivot assembly.

With reference to FIG. 2, which is an enlarged view of section A from FIG. 1, the tilt pivot assembly 500 is preferably operatively associated with the upper sash 300. The weatherstripping assembly 220 operatively engages with the tilt pivot assembly 500. In a preferred embodiment, the weatherstripping assembly forms an upper sash track 222 which restrains the tilt pivot assembly 500 to moving in a vertical direction upon removal of retaining screw 523, as described in more detail below. The tilt pivot assembly 500 may comprise a tilt pivot pin assembly 520, and a tilt pivot shoe assembly 510, as described in more detail below.

Figure 3:
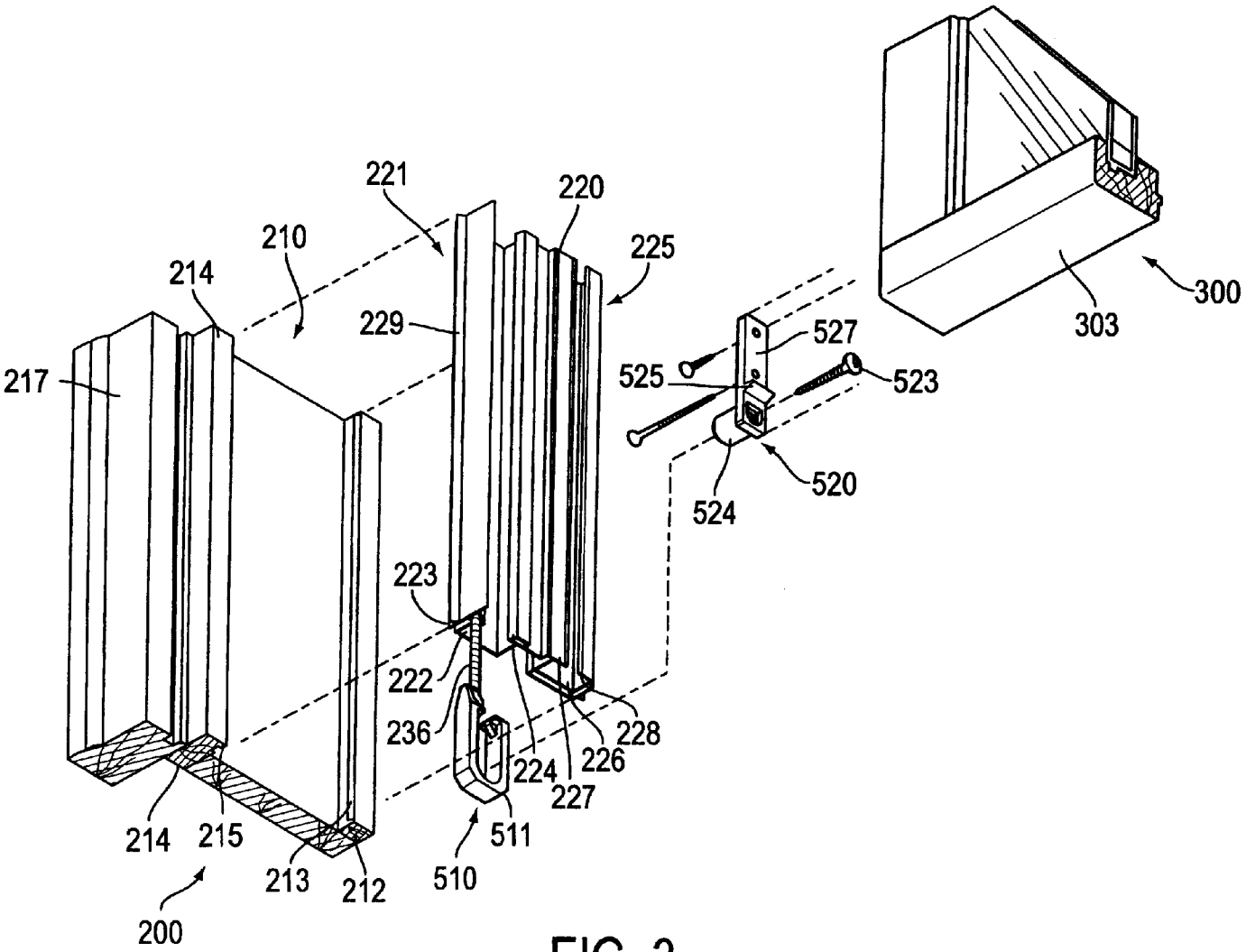
FIG. 3 shows an exploded view of the tilt pivot assembly and the components with which the tilt pivot assembly operatively interacts.

FIG. 3 is an exploded view of section A from FIG. 1. Window jamb 210 preferably includes an inside tilt stop 212 and a blind stop 214. Stops 212 and 214 preferably have retaining fins 213 and 215, respectively, for securing the weatherstripping assembly 220 to the window frame 200. In use, weatherstripping assembly 220 may form a weather-tight seal between the upper sash 300 and the window frame 200. Weatherstripping assembly 220 may optionally house the tilt pivot shoe bracket 511 and the upper spring 236. The upper spring 236 is preferably attached to the pivot shoe bracket 511, which in turn operatively engages the tilt pivot pin assembly 520. Because the tilt pivot pin assembly 520 is operatively attached to the upper sash 300 in a preferred embodiment, the upper spring 236 and pivot shoe bracket 511 may serve as a balance assembly for the upper sash 300, as is well known in the art.

Figure 9:
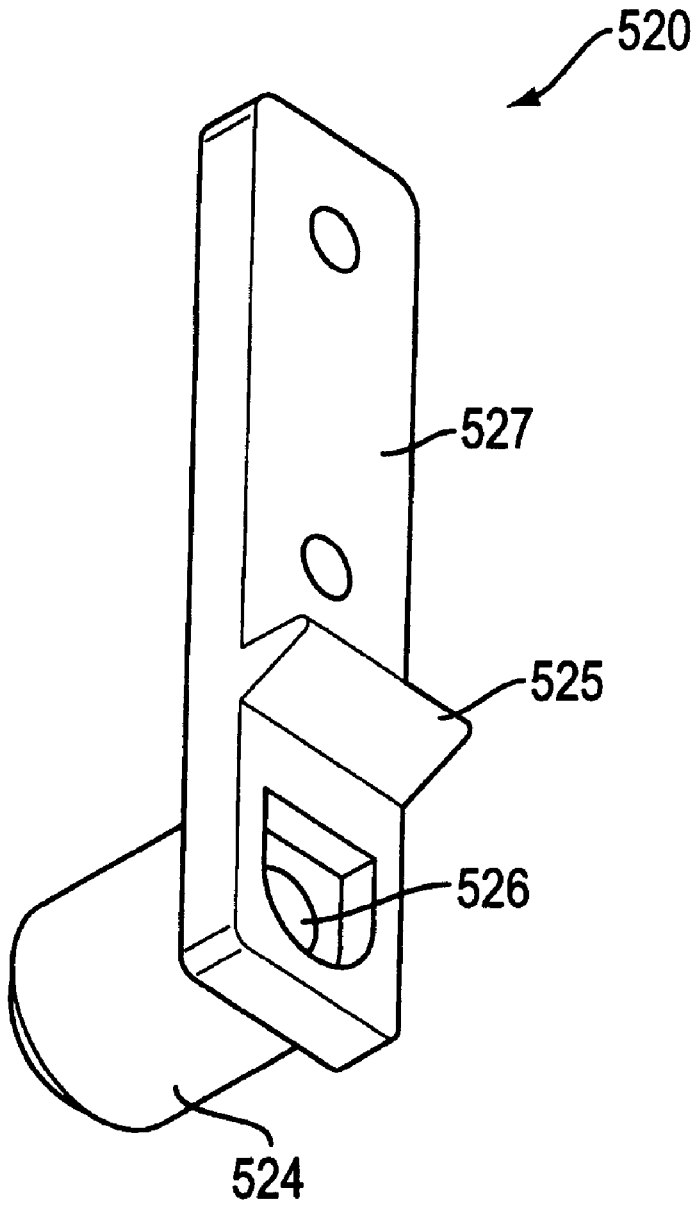
FIG. 9 shows a perspective view of the tilt pivot pin assembly.

As best seen in FIG. 9 in conjunction with FIG. 3, the tilt pivot pin assembly 520 may include a pivot pin base plate 527 which attaches to a side of a lower rail 303 of the top sash 300. Assembly 520 also includes a pivot pin support fin 525 formed integrally with the pivot pin base plate 527. Support fin 525 is adapted to extend along the bottom of the lower rail 303 of the top sash 300. Additionally, the tilt pivot pin assembly 520 may include a cylindrical engaging element 524 extending from an opposite side of the pivot pin base plate 527 with respect to the pivot pin support fin 525. Engaging element 524 preferably has an engaging element hole 526, and a retaining screw 523 (FIG. 3) which is removably inserted through the engaging element hole 526. In use, the retaining screw 523 is preferably secured through the weatherstripping assembly 220, and into the window jamb 210.

Figure 10:
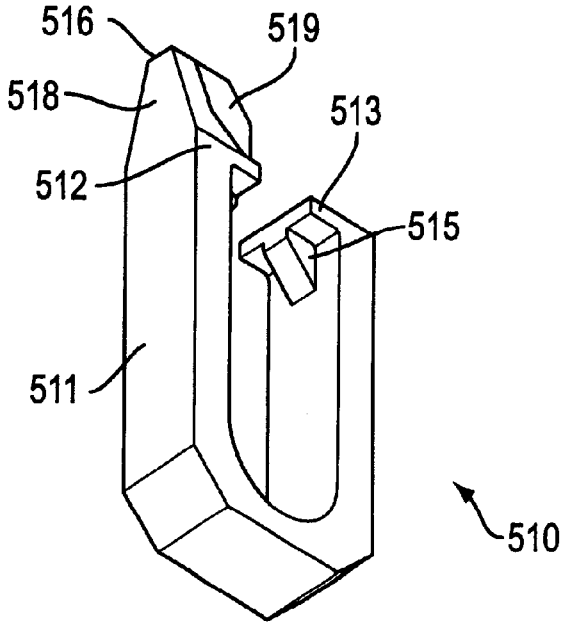
FIG. 10 shows a perspective view of the tilt pivot shoe assembly.
Figure 11:
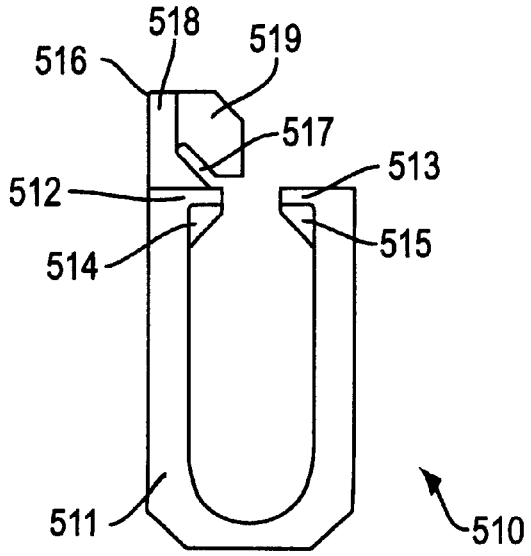
FIG. 11 shows a side view of the tilt pivot shoe assembly.

FIGS. 10 and 11 illustrate a preferred form of the tilt pivot shoe assembly 510. The tilt pivot shoe assembly 510 may include a pivot shoe bracket 511, a first and second bracket strut 514 and 515, and a first and second engaging element retaining fin 512 and 513, respectively. The tilt pivot shoe assembly 510 preferably has a generally U-shaped configuration. The first retaining fin 512 may additionally have a spring notch 517, a spring notch support flange 518, and a spring notch base plate 519 for connecting the tilt pivot shoe bracket 511 to the upper sash spring 236 (FIG. 3).

Referring again to FIG. 3, in use the cylindrical engaging element 524 operatively engages the pivot shoe bracket 511. Retaining screw 523 may be secured through the engaging element hole 526 (FIG. 9) and secured to the window jamb 210 through the weatherstripping assembly 220. A series of retaining screw retaining holes (not shown) can also be used to allow the position of a sash to be indexed to any desired location. The retaining screw retaining hole can be reinforced to withstand repeated insertions and extractions of the retaining screw 523. Instead of using a retaining screw 523, any suitable method of operatively engaging the cylindrical engaging element 524 to the window frame 200 can be used. For example, the engaging element could be provided with extendible guide pins or any other retractable pins.

Although the preferred embodiment is shown as having cylindrical engaging elements 523 with retaining screws 524 only on the upper sash, the invention is not limited to this configuration, as the tilt pivot assembly 500 could be applied to both the upper and lower sashes. Additionally, this invention could utilize removable guide pins instead of retaining screws 523. Such a configuration would enable, for example, use of readily removable guide pins in conjunction with modified retaining screws. The modified retaining screws could have non-standard exposed faces, requiring a key tool such as an Allen wrench to insert or extract them. For example, if the objective is to provide an open sash for ventilation while maintaining a secure environment, a designer could select modified retaining screws for the externally exposed engaging elements and utilize readily adjustable extendible guide pins on an engaging element that is not accessible from outside the premises. Such a configuration would allow for ventilation and security, and could be configured to satisfy various egress building code requirements.

When the retaining screw 523 is not utilized, the tilt pivot shoe assembly 510 may be used as a balance in conjunction with upper sash spring 236, as is well known in the art. The weatherstripping 220 preferably serves as a balance housing for the upper sash 300 and the lower sash 400. The weatherstripping 220 may have two main structural elements, an upper sash weatherstripping assembly 221 and a lower sash weatherstripping assembly 225. The upper and lower sash weatherstripping assemblies 221 and 225 generally have three sides, forming a substantially box U-shape. At the terminal points of the upper sash weatherstripping assembly 221 are the exterior and interior upper pivot shoe bracket retaining fins 223 and 224, respectively (FIG. 3). The pivot shoe bracket retaining fins 223, 224 retain the pivot shoe bracket 511 within the confines of the weatherstripping assembly 220.

Figure 4:
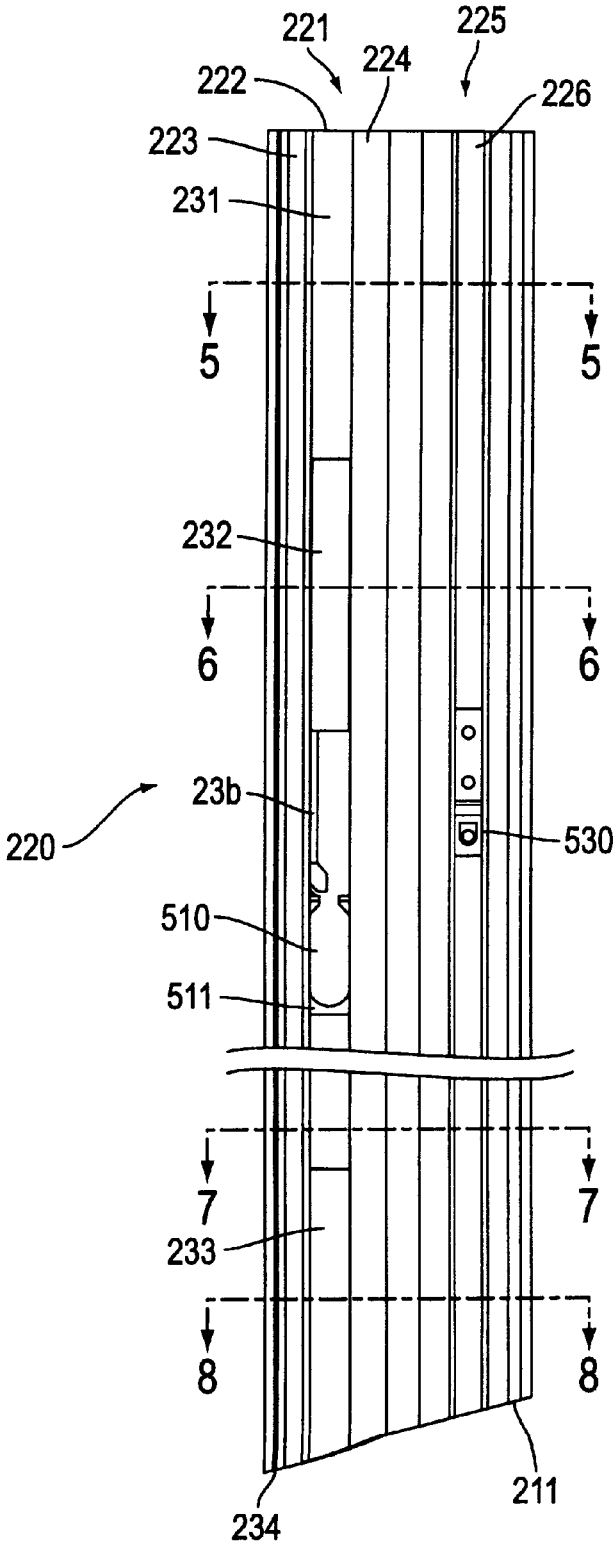
FIG. 4 shows a side view of the weatherstripping assembly.

With reference to FIG. 4, the weatherstripping assembly 220 preferably has at least four different cross sections/regions on the upper sash track 222. Each of these different cross sections is depicted in FIGS. 5–8. The upper sash 300 preferably can be translated vertically between a first and second position. The first position is the uppermost position of the upper sash 300 in the window frame 200, defined by contact between the top rail of the upper sash 302 (FIG. 1) and the window frame 200. The second position is the lowermost position of the upper sash 300, defined by contact between the cylindrical engaging element 524 fixedly attached to the upper sash 300 and a stopping extrusion 233 (FIG. 8) integrally formed on the weatherstripping assembly 220, as discussed in more detail below.

Figure 5:
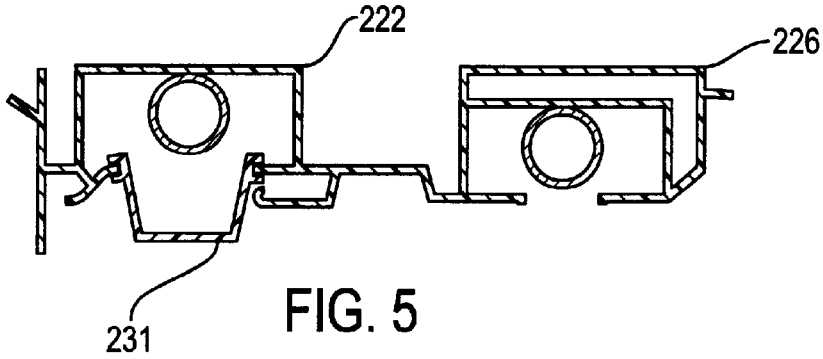
FIG. 5 shows a cross-section of the weatherstripping assembly taken along the line 5—5 of FIG. 4.

A preferred embodiment of the first region, or the "retaining" region, is depicted in FIG. 5. This region preferably includes a retaining extrusion 231. Retaining extrusion 231 can operatively engage with the upper sash 300 to prevent pivoting of the upper sash 300 while any portion of the upper sash 300 is contiguous with, or, in other words, above the lowest portion of the retaining extrusion 231. For example, the retaining extrusion 231 could fit within a channel along the side of the upper sash 300. Although the upper retaining mechanism is depicted as an extrusion in one embodiment, the use of any mechanism that will operatively retain the upper sash 300 in the weatherstripping assembly 220 in the upper portion of a window frame 200 is contemplated. For example, it is possible to use an extrusion attached to the upper sash 300 that can fit within a channel of the weatherstripping assembly 220.

Figure 6:
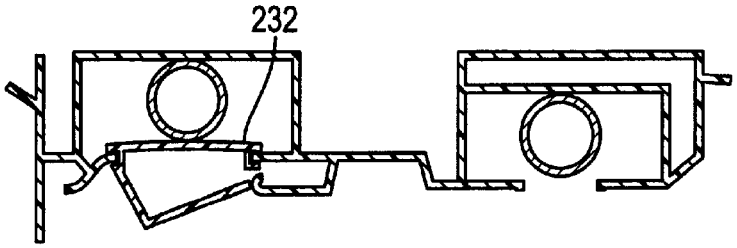
FIG. 6 shows a cross-section of the weatherstripping assembly taken along the line 6—6 of FIG. 4.

A preferred embodiment of the second region, or the "resistance" region, is depicted in FIG. 6. At least in the resistance region, it is preferable to have a extrusion that prevents the upper sash 300 from rotating to the exterior of the building when a predetermined force is applied to the upper sash top rail 302. In a preferred embodiment, the exterior sash retaining rail 234 extends along the entire vertical length of each side of the weatherstripping assembly 220. The resistance region can have a resistance extrusion 232 which creates a frictional force opposing motion when force is applied to the upper sash top rail 302 in an inward direction. Although a predetermined force will be sufficient to overcome the friction force of the resistance extrusion 232, the upper sash 300 preferably will not rotate out of the window frame 200 without the application of a predetermined force.

Figure 7:
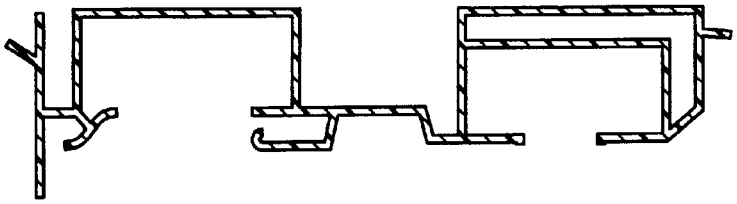
FIG. 7 shows a cross-section of the weatherstripping assembly taken along the line 7—7 of FIG. 4.

A preferred embodiment of the third region, or "free" region, is depicted in FIG. 7. The free region preferably has an upper sash track 222 free of extrusions. The cylindrical engaging element 524 of tilt pivot pin assembly 520 may be inserted into the gap between the interior and exterior pivot shoe bracket retaining fins 223 and 224. A pivot shoe bracket 511 is preferably inserted into the upper sash track 222 and retained by the interior and exterior pivot shoe bracket retaining fins 223 and 224. An upper sash spring 236 may be operatively connected between the pivot shoe bracket 511 and the top of weatherstripping assembly 220. Additionally, the cylindrical engaging element 524 may be operatively interconnected with the pivot shoe bracket 511 in order to provide a balance to the upper sash 300, as is well known in the art.

Figure 8:
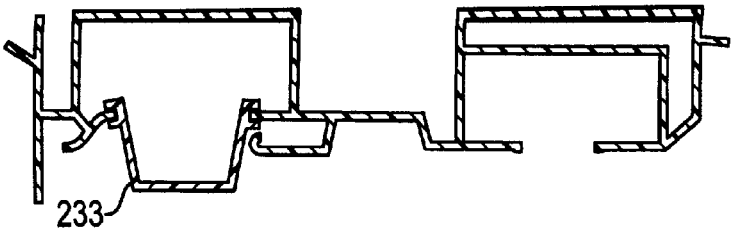
FIG. 8 shows a cross-section of the weatherstripping assembly taken along the line 8—8 of FIG. 4.

A preferred embodiment of the fourth region, or "stopping" region, is depicted in FIG. 8. The stopping region preferably has a stopping extrusion 233 that prevents the cylindrical engaging element 524 from translating below the top of the stopping extrusion 233.

The preferred embodiment enables removal of the upper sash 300 without the use of retaining pins on the upper rail 302 of the upper sash 300. In the preferred embodiment, the lower sash 400 must be removed in order for the upper sash 300 to be removed. As stated previously, the exterior sash retaining rail 234 preferably prevents the upper sash 300 from rotating to the outside of the premises. While the upper sash 300 is in the first position, or upper position, the upper sash 300 is operatively engaged by the retaining extrusion 231 to prevent rotation of the upper sash 300 into a first rotation position. While the upper sash 300 is in the second position, or lower position, the lower sash top rail 402 preferably contacts the side rails of the upper sash to prevent rotation of the upper sash 300 into the first position. Because the upper sash 300 preferably cannot rotate, the upper sash 300 cannot be removed while lower sash 400 is operatively engaged by the weatherstripping assembly 220.

Referring now to FIGS. 1 and 4, a preferred process of removing the upper sash 300 and the lower sash 400 from the window frame will be disclosed. First, the lower window sash 400 is removed. This process may involve the withdrawal of retaining pins also known as tilt latches (not shown) from the lower sash track 226. The lower sash 400 can then be rotated inward while the lower engaging elements (not shown) are still operatively engaged by the weatherstripping assembly 220. The lower sash 400 is preferably rotated approximately 90 degrees to a first rotation position. Once in a first rotation position, the lower sash 400 can be rotated about a second axis of rotation. This second axis of rotation is perpendicular to the first axis of rotation, and it lies on the same plane as the lower sash 400 while the lower sash 400 is in the first rotation position. Rotation about this second axis of rotation releases the lower sash 400 engaging elements (not shown) from the lower pivot shoe bracket 530 (FIG. 4).

Upon removal of the lower sash 400, the upper sash 300 is preferably translated into the second or lowermost position, described previously. Once in the second position, the upper portion of the upper sash 300 operatively engages the resistance extrusion 232 of the weatherstripping assembly 220. Then, upon application of a predetermined force at the upper portion of the upper sash 300 in an inward direction, the upper sash 300 may rotate about a first axis to a first rotation position. The first axis is defined by a line connecting the cylindrical engaging elements 524 on the left and right side of the bottom rail 303 of the upper sash 300.

The upper sash 300 is preferably rotated approximately 90 degrees to a first rotation position. Once in a first rotation position, the upper sash 300 can be rotated about a second axis of rotation. This second axis of rotation is perpendicular to the first axis of rotation, and lies on the same plane as the upper sash 300 while the upper sash is in a first rotation position. Rotation about the second axis of rotation preferably releases the cylindrical engaging elements 524 of the upper sash 300 from the pivot shoe brackets 511.

Although the present invention has been described in relation to a preferred embodiment, it is understood that the disclosure is illustrative. The descriptions provided in the disclosure should not be construed to limit any aspect of the present invention. Those skilled in the art will recognize additional embodiments and applications of the present invention. Accordingly, the present invention is limited only to the extent of the following claims.

What is claimed is:

1. A window system comprising:

a first sash;

a second sash;

a weatherstripping assembly for retaining the first and second sashes;

a frame for retaining the weatherstripping assembly;

at least one tilt pivot assembly associated with the first sash defining an axis of rotation of the first sash relative to the frame, the tilt pivot assembly being slidably interconnected with the weatherstripping assembly; and means for securing the tilt pivot assembly to the frame, wherein only upon removal of the means for securing the tilt pivot assembly, the first sash slides in relation to the frame, and wherein when the means is not removed, the first sash is prevented from sliding in relation to the frame.

2. The window system of claim 1 wherein the weatherstripping assembly comprises:

two vertically displaced channels; and a first of the vertically displaced channels has at least two regions including a retaining region, and at least one of a resistance region or a free region.

3. The window system of claim 1 wherein the tilt pivot assembly further comprises:

a tilt pivot shoe assembly and a spring assembly, wherein the spring assembly operatively engages the tilt pivot shoe assembly and the weatherstripping assembly.

4. The window system of claim 3 wherein the tilt pivot assembly further comprises:

a tilt pivot pin assembly operatively engaging the tilt pivot shoe assembly, said tilt pivot pin assembly fixedly attached to the first sash.

5. The window system of claim 4 wherein:

said means for securing said tilt pivot assembly to the frame comprises a retaining screw secured through said tilt pivot pin assembly and secured into said frame through said weatherstripping.

6. The window system of claim 4 wherein the tilt pivot pin assembly comprises:

a pivot pin base plate;

an engaging element integrally attached on a second side of the pivot pin base plate, wherein said engaging element has an engaging element hole through which said means for securing said tilt assembly is removably inserted.

7. The window system of claim 6 wherein the tilt pivot shoe assembly comprises:

at least one pivot shoe bracket having a generally U-shaped configuration and having a first and second terminal point;

a first and second retaining fin integrally attached to the first and second terminal points, wherein the first retaining fin additionally comprises a spring notch, and a spring notch base plate; and a first bracket strut integrally connected to the pivot shoe bracket and the first retaining fin and a second bracket strut integrally connected to the pivot shoe bracket and the second retaining fin.

8. The window system of claim 7 wherein:

the tilt pivot shoe assembly operatively engages the engaging element of the tilt pivot pin assembly; and wherein vertical displacement of the first sash results in vertical displacement of the tilt pivot pin assembly and tilt pivot shoe assembly, resulting in increased or decreased tension within the spring assembly.

9. The window system of claim 1, wherein the second sash slides in relation to the frame, and whereby when the means for securing the tilt pivot assembly is removed, the window system is converted from a single-hung window system to a double-hung window system.

10. A method of transporting a convertible window system, the convertible window system comprising a first sash, a second sash, a weatherstripping assembly for retaining the first and second sashes, a frame for retaining the weatherstripping assembly, at least one tilt pivot assembly associated with the first sash defining an axis of rotation of the first sash relative to the frame, and slidably interconnected with the weatherstripping assembly, and means for retaining the tilt pivot assembly to the frame to prevent sliding of the first sash relative to the frame, said method comprising the steps of:

inserting at least one means for retaining through the tilt pivot assembly and into the frame or the weatherstripping assembly;

transporting the convertible window system to a target destination; and removing the means for retaining to allow sliding of the first sash relative to the frame.

11. A weatherstripping assembly for a window system with at least one sash, the weatherstripping assembly comprising:

a first channel with a longitudinal axis;

the first channel comprising two longitudinally spaced regions, the two regions comprising a retaining region and a resistance region, wherein the retaining region will operatively interconnect with a sash of a window system enabling translation of the sash relative to the weatherstripping assembly in the direction of the longitudinal axis and preventing rotation of a portion of the sash contiguous to the retaining region, and wherein the resistance region will enable translation of the sash relative to the weatherstripping in the direction of the longitudinal axis and will enable rotation of a portion of the sash contiguous to the resistance region when a predetermined force is applied normal to the sash.

12. The weatherstripping assembly of claim 11 wherein the resistance region comprises a biasing element which interconnects with the first channel, and which in operation is biased by a side of the sash and applies a force to the side of the sash to keep the sash within the weatherstripping assembly, and wherein a predetermined amount of force applied normal to the sash would cause the force of the biasing element applied to the side of the sash to be overcome and would cause rotation of the sash relative to the weatherstripping assembly.

13. The weatherstripping assembly of claim 12 wherein the retaining region comprises an engaging element which interconnects with the first channel and which may be engaged by a channel in the sash, and wherein the sash can translate in relation to the engaging element but a portion of the sash engaging the engaging element cannot be rotated.

14. The weatherstripping assembly of claim 12 further comprising a longitudinally spaced free region and stopping region, wherein the stopping region comprises a stopping element which interconnects with the first channel and will prevent translation of a bottom of the sash below a top of the stopping element.

15. A window system comprising:

a frame with an indoor face and an outdoor face and a left side and a right side;

a weatherstripping assembly having a longitudinal axis and comprising a left portion defining a left channel attached to said left side of said frame, a right portion defining a right channel attached to said right side of said frame;

a first and second sash;

said second sash is operatively engaged with said weatherstripping assembly and is slidable in relation to said weatherstripping assembly in the direction of the longitudinal axis and tiltable relative to said weatherstripping assembly in a direction generally outwardly from said indoor face of said frame;

said first sash is attached to a left-side and a right-side tilt pivot assembly, the left-side tilt pivot assembly operatively engaging said left channel of said left portion of said weatherstripping assembly for sliding and pivoting movement, the right-side tilt pivot assembly operatively engaging said right channel of said right portion of said weatherstripping assembly for sliding and pivoting movement, said first sash pivoting in a direction generally out from said indoor face of said frame;

said left and right channels of said weatherstripping assembly each comprise a retaining region, and at least one of a free region or a resistance region, all of the regions being longitudinally spaced along the longitudinal axis from each other; and wherein, when a portion of said first sash is contiguous with said retaining regions of said left and right channels, said first sash may not pivot relative to said weatherstripping assembly.

16. The window system of claim 15, wherein, said first sash may not pivot unless the second sash has been at least partially pivoted.

17. The window system of claim 15, further comprising a retaining rail attached to said outdoor face of said frame, said retaining rail prevents the first sash from pivoting in a direction generally out from said outdoor face of said frame.

18. The window system of claim 15, wherein said at least one of a free region and a resistance region comprises both a resistance region and a free region;

wherein all of said regions are each longitudinally spaced from one another; and wherein when no portion of said first sash is contiguous with said retaining region, and a portion of the first sash is contiguous with the resistance region, the first sash may be tilted in a direction generally outwardly from said indoor face of said frame only upon application of a predetermined force in a direction generally normal to said indoor face of said frame.

19. The window system of claim 18, said left and right channels further comprise a stopping region longitudinally spaced from said retaining region, said free region, and said resistance region; and wherein said first sash is prevented from sliding relative to said weatherstripping assembly into a position contiguous with the stopping region.

20. The window system of claim 19, at least one of said left-side and said right-side tilting assembly comprises a retaining means for retaining the tilting assembly to said frame, and for preventing sliding movement of said first sash.

* * * * *